United States Patent [19]

Boganowski

[11] 4,150,823

[45] Apr. 24, 1979

[54] TARGETABLE PROJECTILE AMUSEMENT APPARATUS

[76] Inventor: David A. Boganowski, 14216 Birchwood Cir., Omaha, Nebr. 68137

[21] Appl. No.: 805,528

[22] Filed: Jun. 10, 1977

[51] Int. Cl.[2] ..... A63B 67/04

[52] U.S. Cl. ..... 273/94 R; 273/102 R; 273/106.5 A; 273/DIG. 30

[58] Field of Search ..... 273/85 R, 85 E, 85 F, 273/DIG. 30, 94, 55 R, 106.5 A, 102 R

[56] References Cited

U.S. PATENT DOCUMENTS

| | | | |
|---|---|---|---|
| 3,391,933 | 7/1968 | Cooper | 273/85 F |
| 3,592,470 | 7/1971 | Breslow | 273/85 E X |
| 3,675,921 | 7/1972 | Meyers | 273/85 R X |
| 3,680,862 | 8/1972 | Russell et al. | 273/55 R |
| 3,979,117 | 9/1976 | Worsham | 273/94 R X |
| 3,997,162 | 12/1976 | Scullin | 273/106.5 A X |

*Primary Examiner*—Paul E. Shapiro
*Attorney, Agent, or Firm*—George R. Nimmer

[57] ABSTRACT

Disclosed is amusement apparatus for an offensive player aiming a physical projectile toward a selected target attached to a base member and for a defensive player actively controllably defending one or more targets with a mechanical shield movably associated with the base member. The amusement apparatus concept herein is adaptable for an exceedingly challenging and remarkably realistic gridiron football type game wherein the aimable physical projectile is aerial, analagous to the gridiron quaterback and football-receiver situation, with the controllably movable shield being analagous to a football-defenseman. For the gridiron football game type embodiment, the aerial projectile is desireably a dart, and preferably wherein the combination dart leadward-end and the target is of the removably secureable hooks-and-eyes or "Velcro" type.

13 Claims, 5 Drawing Figures

TARGETABLE PROJECTILE AMUSEMENT APPARATUS

There are in the prior art projectile type amusement apparatuses wherein an offensive player aims a projectile toward a target attached to a base member field, conventionally the projectile being a rolling ball along a horizontal planar top-surface for the base member.

Also in the prior art are numerous aerial projectile amusement apparatuses, such as using hand-thrown flighted darts, aerial pellets, basketballs, baseballs, etc.

Gridiron football has a great spectator following among the public, both at professional and amateur stadia, and through radio and television mass media. Accordingly, there is the quest among knowledgeable workers in the amusement apparatus art to provide such apparatus that might simulate, as realistically as possible, gridiron football. Illustrative of such amusement apparatus prior art are U.S. Pat. Nos. 1,141,624(1915); 3,046,015 (1962); 3,554,548(1971); 3,630,522(1971); and 3,979,117(1976). However, none of these prior art workers has been able to realistically simulate gridiron football playing situations of a quarterback rendering a forward pass to a football-receiver covered by a roving football-defenseman.

It is accordingly the general object of the present invention to provide a sophisticated and unusually challenging concept for aimable projectile amusement apparatus wherein the target is controllably protectable by the defensive player with a shield member movably associated with the apparatus base member. It is an ancillary and related general objective to provide aimable projectile amusement apparatus amenable to aerial projectiles(particularly darts) and providing simulated, though unusually challenging and realistic, gridiron football game situations.

With the above and other related and ancillary objects and advantages in view, which will become more apparent as this description proceeds, the targetable projectile amusement apparatus of the present invention generally comprises a projectile aimable by an offensive player toward a target attached to a base member having a top-surface, the target being actively controllably defendable with a remotely handled shield movably associated with the base member, three or more cooperating and distinctly separated pairs of targets and resiliently biased shields providing a particularly challenging situation; for realistically simulating a gridiron football situation, targets and shields are loftily disposed above the base member top-surface upon football player figurines, a potential fieldgoal situation providing a further optional target for an appropriate dart or other aerial projectile.

In the drawing, wherein like characters refer to like parts in the several views, and in which.

Figure 1:
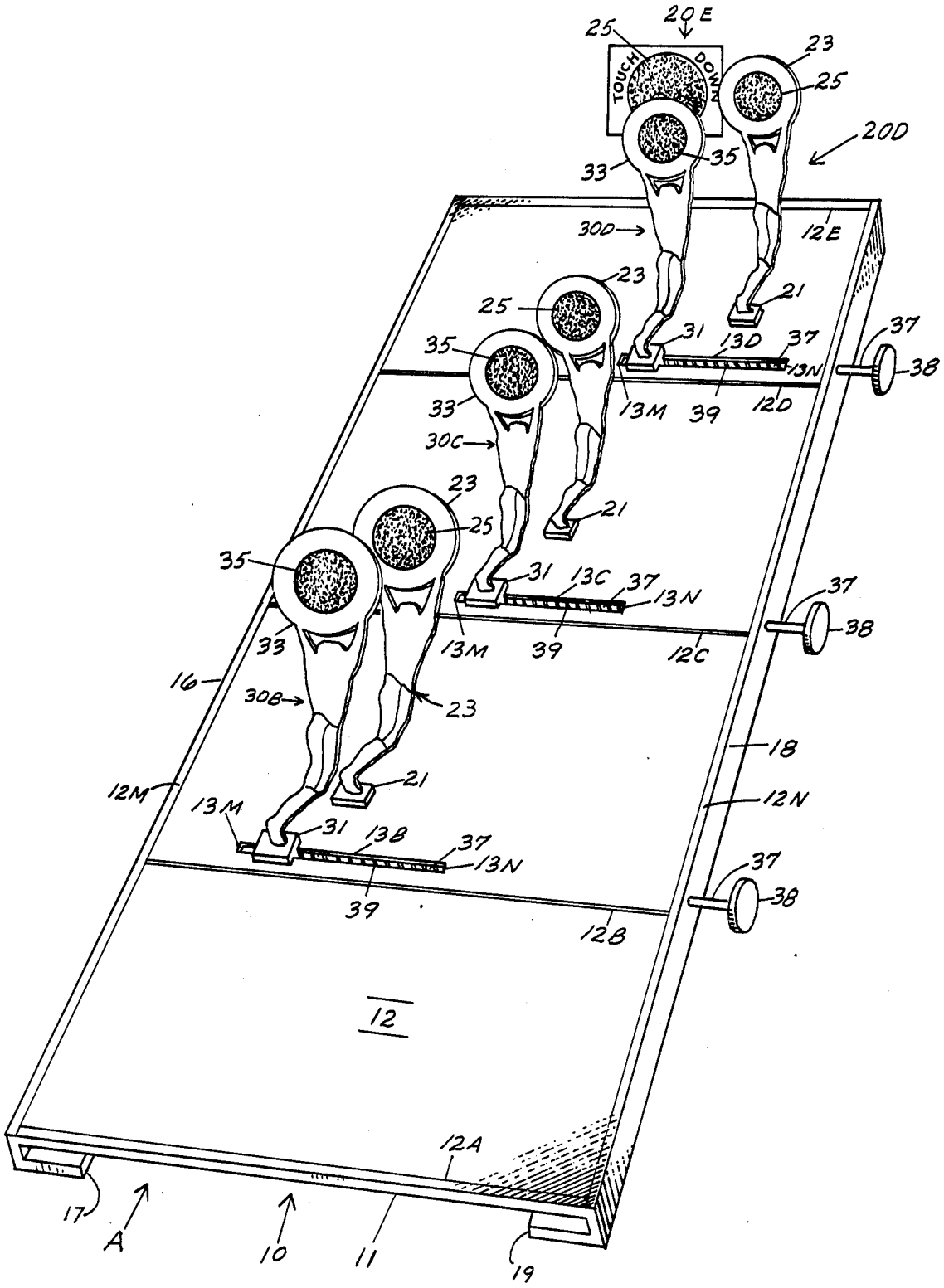
FIG. 1 is a perspective view of a representative embodiment of the targetable projectile amusement apparatus concept of the present invention.

Amusement apparatus embodiment "A" generally comprises a base member 10 adapted to stably rest upon an underlying horizontal substrate 9 and including a top-surface 12 extending along a horizontal longitudinal-axis 10A, a plurality of target-assemblies 20 attached to base member 10 and including a target 25 loftily disposed at target-elevation above base member 10, an aerial projectile 50 for hurling toward a selected frontally facing target 25, and a plurality of shield-assemblies 30 transversely movably associated with the base member and including a shield 35 at target-elevation and hence potentially longitudinally alignable with and thereat protecting its assigned target 25, the respective shield-assemblies 30 being manually transversely actuatable with a wieldable handle 38.

Base member 10 is herein provided of a single rectangular piece of metallic plate permanently bent along four longitudinal lines to provide a horizontal top-panel 11 extending along longitudinal-axis 10A, a pair of upright planar panels including left-side 16 and right-side 18, and a pair of longitudinally extending toes(terminating at 17 and 19) and adapted to rest upon substrate 9. Base member top-panel 11 provides the playing field, herein simulating a football gridiron, including longitudinally extending sides as left-sideline 12M and right-sideline 12N. Top-surface 12 also has a pair of transverse ends including a front-end 12A and a rear-end 12E, corresponding to football goalines. Similarly shown are regularly spaced transverse yardlines 12B, 12C (midfield), and 12D. Lines 12A–12E and 12M–12N might conveniently take the form of painted or tape adherent strips upon top-panel 11.

Figure 3:
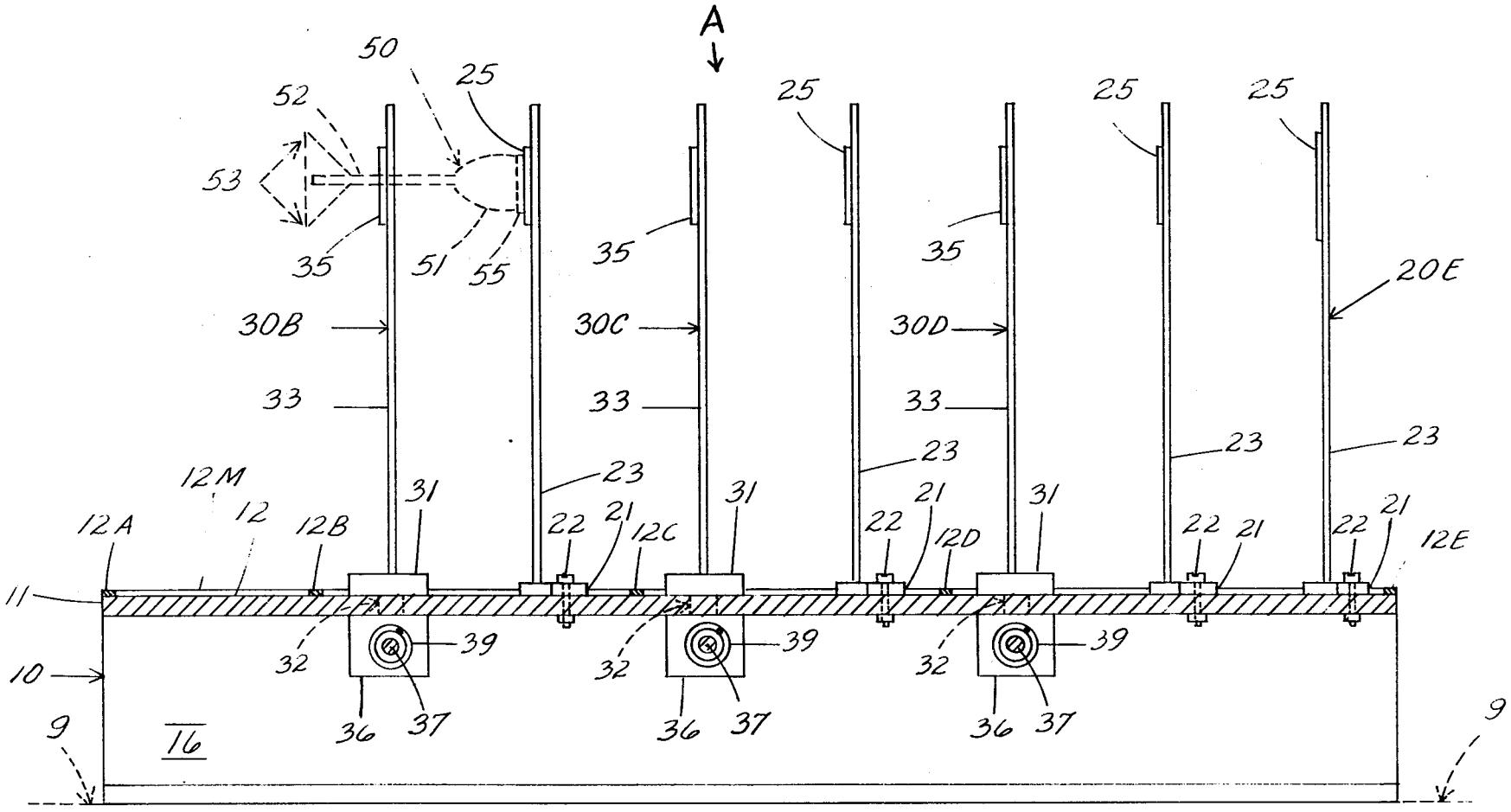
FIG. 3 is a sectional elevational view taken along lines 3—3 of FIG. 2.

There is a plurality of targets attached to base member 10, each target frontally facing front-end 12A and being adapted to be struck frontally by a suitable physical projectile aimed toward base member rear-end 12E. The respective targets are preferably of stationary transverse location along the base member, and most desireably at distinct transverse increments between sidelines 12M and 12N to give the offensive player a realistically attainable selection of targets. For example, target-assembly 20B is shown relatively near sideline 12M, target-assembly 20D is relatively near sideline 12N, while target-assemblies 20C and 20E are about midway sidelines 12M and 12N. Respective targets are preferably of stationary longitudinal location along the base member, and most desireably at distinctly separated longitudinal stations between ends 12A and 12E to simulate offensive progress toward the rear-end goal 12E, final target-assembly 20E being thereat. For use with an aerial projectile e.g. 50, the targets 25 are best disposed a lofty target-elevation above base member top-surface 12, as best seen in FIGS. 1 and 3. In this vein, for realistic football type embodiments of the amusement apparatus, the target 25 is maintained at fixed target-elevation by an upright football-receiver-man figurine 23. To complete each target-assembly 20, the bottom end of figurine 23 is attached to pedestal 21 downwardly abutting top-panel 11 and securely attached thereto, as by vertical screw 22. Each target 25 extends in the transverse direction and faces frontally toward front-end 12A.

Figure 5:
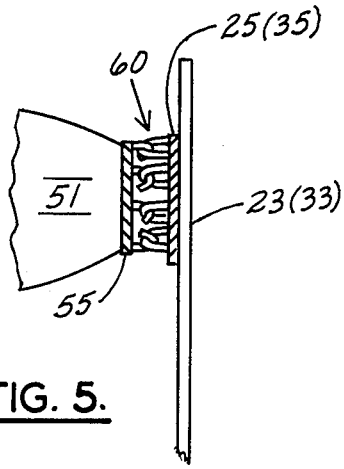
FIG. 5 is a detail elevational view of a removably securable type aerial projectile at a target.

In the case of the loftily disposed type targets 25, for aerial projectiles, the success of target negotiation should be clearly indicated. In this regard, dart aerial projectiles are preferred which require a target physically structured to securely but removably receive the leadward-end of the impinging aerial dart. For safety reasons, to avoid injury to the defensive player who is manipulating the shield-assemblies 30, non-metallic e.g. "Velcro", darts are preferred. The "Velcro" concept is disclosed in prior U.S. Patents to George de Mestral (Nos. 2,717,437; 2,933,797; and 3,009,235), and is sometimes referred to as "removable adherent means of the non-metallic hooks-and-eyes type". For example, in FIG. 5 of the drawing herein, target pads 25 and the dart leadward-end pad 55 provide the respective hooks pads and eyes pads described by de Mestral. The dart leadward-end padd 55 is attached to the bulbous body 51 of dart 50, which has appropriate shaft 52 and flights 53 remote of leadward-end pad 55.

There is a plurality of shields actuatably connected to the base member and capable of physically protecting the respective targets from being struck by an aimed projectile. Each of the shields includes a handle means control (38) located outside the base member perimeter and thereat wieldable by the defensive player whereby he might manually controllably protect the respective targets from the offensively aimed projectile. Each target has its own shield assigned thereto and located adjacently forwardly thereof, the shield being manually controllably movable in the transverse direction by the handle means thereof. For example, shield-assembly 30B is assigned to target-assembly 20B, shield-assembly 30C assigned to target-assembly 20C, shield-assembly 30D assigned to target-assembly 20D, but target-assembly 20E is herein unshielded for reasons to be explained later. For use in conjunction with lofty targets e.g. 25, the shields 35 are maintained at common target-elevation as by mounting to an upright standard such as football-defenseman figurine 33. Each shield 35 extends in the transverse direction and faces frontally toward the offensive player who is aiming the projectile. Thus, if the defensive player maneuvers a shield 35 in the transverse direction so as to be longitudinally aligned with its assigned target, that target cannot be negotiated by the offensive player's projectile.

Figure 2:
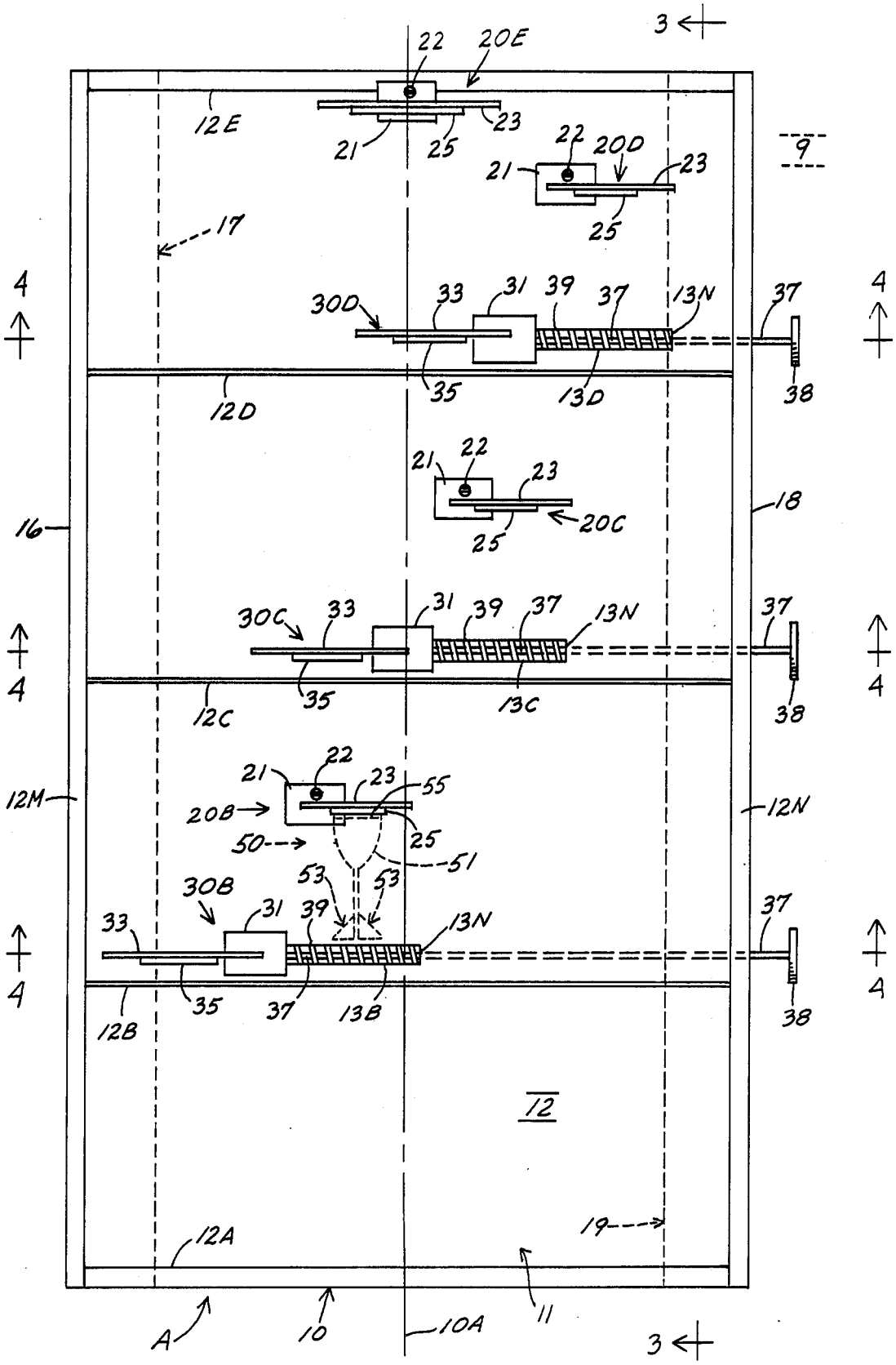
FIG. 2 is a top plan view of the FIG. 1 embodiment.

There are means to prevent the defensive player from simultaneously shieldably protecting all the targets from the aimed projectile. If there were but one or two targets, each protectable with a shield, it would be impossible for the offensive player to successfully neogotiate a target with a projectile e.g. 50. Thus, three or more targets (25) are appropriate, each target being shieldable with an independently controllably (38) transversely movable shield. Moreover, in addition to the provision of three or more independent handles, each shield should be yieldably biased (39) in longitudinal non-alignment and hence in non-protective relationship to its assigned target, as indicated in solid line in FIGS. 2 and 4. In this fashion, a two hands defensive player must restrict handle manipulation to only two shields at any instant of time, the remaining targets being available during that instant to the offensive player's projectile. Without the biasing means (39), it would be an obvious expedient for the defensive player to permanently preset all shields in protective relationships.

Figure 4:
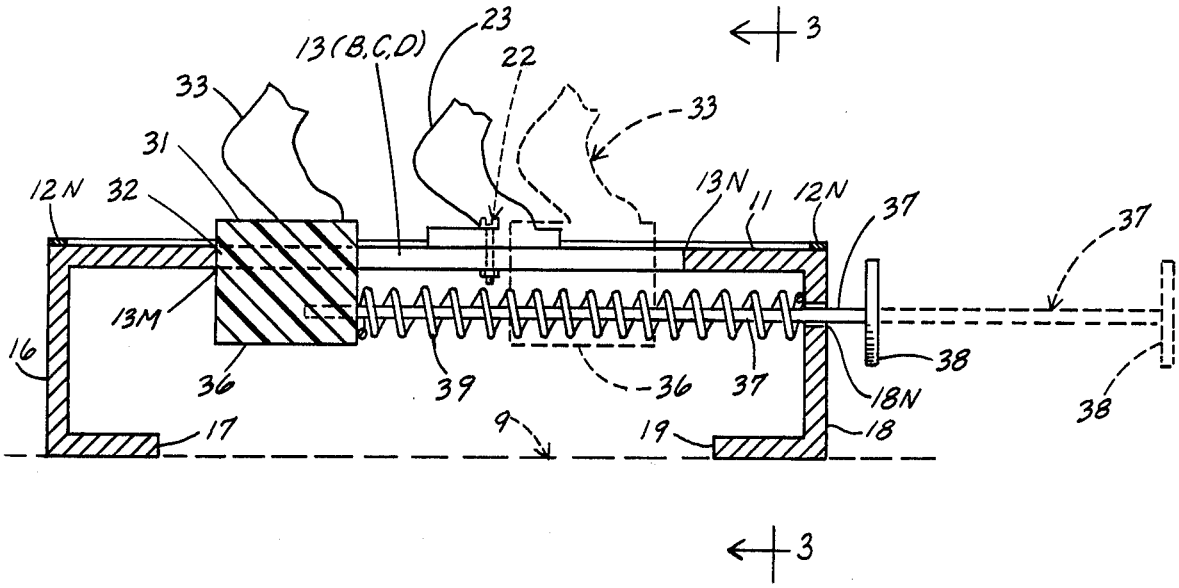
FIG. 4 is a sectional elevational view taken along line 4—4 of FIG. 3.

Each of the three independently transversely manipulatable (38) and resiliently biased (39) shield-assemblies 30 employed in embodiment "A" are identical, as typified in FIG. 4. The shield-carrying upright figurine 33 at its lower end is securely attached to a pedestal 31 downwardly resting upon planar top-surface 12, slide 32 extending rigidly downwardly of pedestal 31 through and guided by a transverse slot 13 having terminii 13M and 13N. Attached to the lower end of slide 32 and upwardly abutting the planar underside of top-panel 11 is a lug 36. Transverse shaft 37 is located parallel to but beneath top-panel slotted portion 13, shaft 37 passing through an aperture 18N of a base member upright side e.g. left-panel 18. The lead-end of shaft 37 is securely attached to lug 36, and the shaft trail-end (outwardly beyond the base member side panel) is provided with a graspable handle 38. A helical spring 39 surrounds shaft 37 and bears from an apertured side (18) of base member 10 to lug 36 whereby the entire shield-assembly 30 is transversely yieldably biased in non-protective relationship to its own assigned target. Only one or two shield-assemblies 30, through separately manually operable handles 38, can be simultaneously manipulated by the defense player to protect arbitrarily chosen targets 25. Thus, there is provided a tactical situation wherein the offensive player must anticipate which target the defensive player will choose not to defend from the launched projectile.

Rules, awards, and further structural refinements might be devised for whatever type game situation would interest the participants. Perhaps the unprotected target of assembly 20E might be of relatively small size to warrant "field goal", "touchdown", or similar high points advantage if successfully negotiated. In football type games, the offensive player might be given four projectiles to launch, corresponding to attainable "first-and-ten". In similar vein, shields 35 might be analagous to target pads 25 for removable adherence with the projectile lead-end, this simulating an "intercepted forward pass" of gridiron football. Some participants might wish to employ a dart projectile (e.g. 50) having an overall length less than the longitudinal distance between the paired target and shield whereby the defensive player cannot dislodge the dart from a successfully negotiated target. These and numerous other combinations of rules, awards, and apparatus structural modifications readily suggest themselves for the amusement apparatus concept herein described.

From the foregoing, the construction and operation of the targetable projectile amusement apparatus will be readily understood and further explanation is believed to be unnecessary. However, since numerous modifications and changes will readily occur to those skilled in the art, it is not desired to limit the invention to the exact construction shown and described, and accordingly, all suitable modifications and equivalents may be resorted to, falling within the scope of the appended claims.

I claim:

1. Targetable projectile amusement apparatus for an offensive player aiming a physical projectile toward a selected target and a defensive player actively controllably defending a target with a movable mechanical shield capable of protecting a target from being struck by said aimed projectile, said amusement apparatus comprising:

A. A base member having a top-surface extending along a generally horizontal longitudinal-axis and adapted to stably rest upon an underlying substrate, said base member including a pair of longitudinally extending sides including a left-side and a right-side and a pair of transversely extending ends including a front-end and a rear-end;

B. A plurality of targets attached to the base member, each of said targets being adapted to be struck frontally by a physical projectile aimed directionally toward the base member rear-end by the offensive player; and C. A plurality of shields transversely movably associated with the base member and capable of physically protecting the respective targets from being struck by said aimed projectile, each of said shields including handle means control located outside the base member perimeter and thereat wieldable by the defensive player whereby he might manually controllably protect the respective said targets from being struck by the offensively aimed projectile.

2. The amusement apparatus of claim 1 wherein each of said targets is of stationary transverse location with respect the base member, and wherein each target is provided with a said transversely movably associated shield located adjacently longitudinally forwardly its assigned target, said shield being manually controllably movable in the transverse direction by the handle means therefor.

3. The amusement apparatus of claim 2 wherein there are at least three said targets spaced at distinct longitudinal stations of the base member; and wherein the respective shield handles are spaced at distinctly separated longitudinal locations and are respectively biased transversely in longitudinal non-alignment and hence in non-protective relationship to its target whereby the defensive player with his two hands cannot simultaneously protect more than two of the targets from the offensively aimed projectile.

4. The amusement apparatus of claim 1 wherein each of the targets uprightly loftily extends above the base member top-surface to a target-elevation and for being struck frontally thereat by an aerial projectile aimed by the offensive player.

5. The amusement apparatus of claim 4 wherein each of said targets is of stationary transverse location along the base member; and wherein each target is provided with its own said transversely movably associated shield located immediately longitudinally forwardly and of common target-elevation, each said shield being controllably movable in the transverse direction with a horizontal handle.

6. The amusement apparatus of claim 5 wherein there are at least three said targets spaced at distinctly separated longitudinal stations of the base member; and wherein the respective shield handles are spaced at separate longitudinal locations and respectively biased transversely in longitudinal non-alignment and hence in non-protective relationship to its assigned target whereby the defensive player with his two hands cannot simultaneously protect more than two of the targets from the offensively aimed projectile.

7. The amusement apparatus of claim 6 wherein the targets are structurally adapted to stationarily receive the leadward-end of a dart type projectile.

8. The amusement apparatus of claim 7 wherein the respective stationary targets include an underlying football-receiver figurine; and wherein the respective shields include an underlying football-defenseman figurine with a transversely extending handlebar for transverse directional control, said figurine and handlebar control therefore being transversely resiliently biased with spring means.

9. Targetable projectile amusement apparatus for an offensive player aiming an aerial physical projectile toward a selected uprightly extending target and a defensive player actively defending the target with a transversely movable shield capable of protecting the target from being struck by said aerial projectile, said amusement apparatus comprising:

A. A base member having a top-surface extending along a longitudinal-axis therefor, said base member perimeter comprising a pair of longitudinally extending sides including a left-side and a right-side and a pair of transversely extending ends including a front-end and a rear-end;

B. At least three stationary targets attached to and uprightly loftily extending above the base member and located a target-elevation above the top-surface, each of said targets being spaced at distinctly separated longitudinal locations of the base member; and C. Three or more uprightly loftily extending shields respectively located immediately forwardly of its target and thereby protecting same from being struck frontally by an oncoming aerial projectile, each of said shields being transversely movably associated with the base member and including its own handle control located beyond the base member perimeter, each shield loftily extending to target-elevation and being yieldably biased in transverse direction to a normal-station in longitudinal non-alignment with its assigned target whereby the defensive player with his two hands cannot simultaneously protect more than two targets from the offensively aimed aerial projectile.

10. The amusement apparatus of claim 9 wherein the respective stationary targets include an underlying football-receiver figurine; and wherein the respective shields include an underlying football-defenseman figurine which is controllably transversely movable with a transversely extending handlebar, said football-defenseman figurine and handlebar therefor being biased transversely with spring means.

11. The amusement apparatus of claim 10 wherein the base member perimeter is rectangular and assimulating a football gridiron field; and wherein there is an uprightly extending fieldgoal target located rearwardly of the three or more said shieldably protected targets.

12. The amusement apparatus of claim 11 wherein the fieldgoal target is devoid of a defensively controllable shield.

13. The amusement apparatus of claim 9 wherein the base member top-surface resembles a football gridiron field; and wherein the aerial projectile is a dart.

* * * * *